US008581804B2

(12) United States Patent
Tyrrell et al.

(10) Patent No.: US 8,581,804 B2
(45) Date of Patent: Nov. 12, 2013

(54) USER PROGRAMMABLE GRAPHICS IN NON-VOLATILE MEMORY FOR EPD DRIVER IC

(75) Inventors: Julian Tyrrell, Swindon (GB); Peter Hayes, Swindon (GB)

(73) Assignee: Dialog Semiconductor GmbH., Kirchheim/Teck-Nabern (DE)

( * ) Notice: Subject to any disclaimer, the term of this patent is extended or adjusted under 35 U.S.C. 154(b) by 374 days.

(21) Appl. No.: 12/799,527

(22) Filed: Apr. 27, 2010

(65) Prior Publication Data

US 2011/0248984 A1 Oct. 13, 2011

(30) Foreign Application Priority Data

Apr. 12, 2010 (EP) ..... 10392002

(51) Int. Cl.
*G09G 3/04* (2006.01)

(52) U.S. Cl.
USPC ..... 345/34; 345/33; 345/107; 345/214; 345/204

(58) Field of Classification Search
USPC ..... 345/107, 204, 214, 212, 33, 34
See application file for complete search history.

(56) References Cited

U.S. PATENT DOCUMENTS 3,858,197 A * 12/1974 Shimizu et al. ..... 345/33
6,906,705 B2 6/2005 Matsuo et al.
2004/0041785 A1 3/2004 Stevens et al.
2008/0238894 A1 10/2008 Ng et al.
2009/0109468 A1 4/2009 Barclay et al.
2009/0256798 A1 10/2009 Low et al.
2009/0309870 A1* 12/2009 Takei ..... 345/214

OTHER PUBLICATIONS

Product Preveiw, SSD1623, "96 Segments With Common 3-Level Generic Display Driver," CMOS Solomon Systech Limited, Copyright 2009, 1 page.
European Search Report 10392002.1-2205, Mail date—Oct. 11, 2010, Dialog Semiconductor GmbH.
"Configurable Timing Controller Design for Active Matrix Electrophoretic Display," by Wen-Chung Kao et al., 2009 IEEE Transactions on Consumer Electronics, vol. 55, No. 1, Feb. 1, 2009, pp. 1-5.

* cited by examiner

*Primary Examiner* — Vijay Shankar
*Assistant Examiner* — Robin Mishler
(74) *Attorney, Agent, or Firm* — Saile Ackerman LLC; Stephen B. Ackerman

(57) ABSTRACT

Systems and methods are disclosed for a display driver having an internal non-volatile memory in order to save memory storage and computation effort of a host processor. In a preferred embodiment of the invention the display driver is applied for an electronic paper display. Contained within the display driver are user-definable display graphics bitmaps, multiple stored bitmaps used to assemble complex display images, and multiple phase tables, each table of arbitrary length. The invention removes the requirement for a host processor to store display images and/or display image decodes of numerical data and simplifies the process required to construct a display image from stored bitmaps. Furthermore the invention provides pre-programmed multiple phase tables (phase/delay waveform definitions), allowing a simple mechanism to alter the waveform generation, required for example to accommodate temperature variations, blanking the display before updating an image, etc.

24 Claims, 4 Drawing Sheets

EXAMPLE DISPLAY

USER PROGRAMMABLE GRAPHICS IN NON-VOLATILE MEMORY FOR EPD DRIVER IC

BACKGROUND OF THE INVENTION (1) Field of the Invention

This invention relates generally to display drivers and relates more specifically to passively segmented Electronic Paper Display (EPD) drivers.

(2) Description of the Prior Art

Electronic paper, e-paper, or electronic ink display is a display technology designed to mimic the appearance of ordinary ink on paper. Unlike a conventional flat panel display, which uses a backlight to illuminate its pixels, electronic paper reflects light like ordinary paper and is capable of holding text and images indefinitely without drawing electricity, while allowing the image to be changed later.

To build e-paper, several different technologies exist, some using plastic substrate and electronics so that the display is flexible. E-paper is considered more comfortable to read than conventional displays. This is due to the stable image, which does not need to be refreshed constantly, the wider viewing angle, and the fact that it reflects ambient light rather than emitting its own light. An e-paper display can be read in direct sunlight without the image fading. Lightweight and durable, e-paper can currently provide color display. The contrast ratio in available displays might be described as similar to that of newspaper.

Currently passive segmented Electronic Paper Display (EPD) drivers as e.g. Solomon Systech Limited Tri-Level Generic Display Driver SSD1623 require the image data to be displayed to be generated by a controller microprocessor. As example, for a prior art bi-level EPD driver a host processor has to generate a complete drive waveform by combining OLD/NEW data with phase/delay waveform requirements.

Other newer EPD drivers contain some internal One Time Programmable (OTP) non-volatile memory to store the phase/delay waveform but require the OLD/NEW data to be loaded from the host processor in order to generate complete the complete drive waveform It is a challenge for the designers of EPD drivers to remove the requirement for host processors to store display images and/or display image decodes of numerical data, to simplify the process required to construct the display image from stored bitmaps, and to providing pre-programmed multiple phase tables (phase/delay waveform definitions, which allow a simple mechanism to alter the waveform generation.

Solutions dealing with EPD drivers are described in the following patents:

U.S. Patent Application Publication (US 2009/0109468 to Barclay et al.) discloses a portable paperless electronic printer for displaying a printed document on an electronic paper display. The paperless electronic printer includes an input to receive print data from an output of a printer driver of a computerized electronic device, a non-volatile electrophoretic display to provide an electronic paper display of stored said print data for a said document page to mimic said document page when printed on paper; and a processor coupled to said input, to non-volatile memory, and to said non-volatile electrophoretic display and configured to input said print data, to store said data derived from said print data in said non-volatile memory, and to provide to said non-volatile electrophoretic display data for displaying a said document page derived from said stored data.

U.S. patent (U.S. Pat. No. 6,906,705 to Matsuo et al.) proposes providing an electronic paper file with high operating performance. The electronic paper file is assumed to comprises an electronic paper of a flexible display medium and a cover to which a plurality of electronic papers is attachable. In the invention, the first storage means stores display-data to be displayed on the electronic paper. The first display control means obtains from the first storage means the display-data corresponding to the desired page selected by the page selecting means and then display them on the electronic paper. Accordingly, even if the enormous pages of the electronic paper were not attached to the electronic paper file, the invention can display the whole of mass data such as an encyclopedia or theses data. Therefore, it is possible to improve the operating performance of the electronic paper file.

U.S. Patent Application (US 2004/0041785 to Stevens et al.) proposes electronic paper methods and systems. In accordance with one embodiment, an electronic paper driver is provided and is configured to receive a document in a first format from an application and convert the document in the first format to a second format that can be used for rendering a display on electronic paper.

Furthermore the data sheet of Tri-Level Generic Display Driver SSD1623 from Solomon Systech Limited describes a CMOS generic driver with controller. SD1623 is equipped with SPI interface with hardware address map setting pin, allowing two or more SSD1623 connected to same SPI bus, increasing the available number of segments.

SUMMARY OF THE INVENTION

A principal object of the present invention is to achieve a display driver requiring minimal memory storage and computational effort of a related host computer.

A further object of the invention is to achieve an electronic paper display driver requiring minimal memory storage and computational effort of a related host computer.

A further object of the invention is to achieve a display driver having an internal non-volatile memory for storing bitmaps and phase tables.

A further object of the invention is to simplify the process required to construct the display image from bitmaps stored.

Moreover an object of the invention is providing multiple phase tables allowing a simple mechanism to alter the waveform generation.

Furthermore an objective of the invention is to deploy an internal sequencer controlling the charge pump and segments output.

In accordance with the objects of this invention a method for a display driver saving memory storage and computation effort of a host processor has been achieved. The method invented comprises, firstly, the steps of: (1) providing a display driver IC, comprising a non-volatile memory, a display sequencer to control a DC-to-DC converter and segment outputs and registers to store new and OLD display data, (2) storing phase table data and display graphics bitmaps into the non-volatile memory, and (3) selecting icon data to create image data to be displayed. Furthermore the display driver invented comprises: (4) selecting phase table data for required waveforms, (5) applying phase table data to icon data previously selected to generate display waveforms, and (6) driving segments output to display image data.

In accordance with the objects of this invention a display driver saving memory storage and computation effort of a host processor has been achieved. The display driver invented comprises, firstly: a non-volatile memory, a digital block comprising a sequencer controlling a charge pump and segments outputs, and an analog circuitry comprising said charge pump providing electrical power for driving display of images. Furthermore the display driver comprises a circuit block comprising said charge pump and analog circuitry, a high voltage output block; providing segment output to the display, and an arrangement of registers wherein NEW and OLD display data are kept and wherein phase decode is performed. Finally the display driver comprises an interface block.

BRIEF DESCRIPTION OF THE DRAWINGS

In the accompanying drawings forming a material part of this description, there is shown.

DESCRIPTION OF THE PREFERRED EMBODIMENTS

Systems and methods for a tri-voltage EPD display driver. A preferred embodiment of the invention has 96 segments output being configurable as a master/slave arrangement to drive a total of 192 segments with two cascaded drivers. The device contains an integrated charge-pump for +/−15V, internal phase table generation, and panel-graphics decoding for ease of use. The interface is a pin selectable Inter Integrated Circuit ($I^2C$) or 4-wire serial peripheral interface (SPI).

Figure 1:
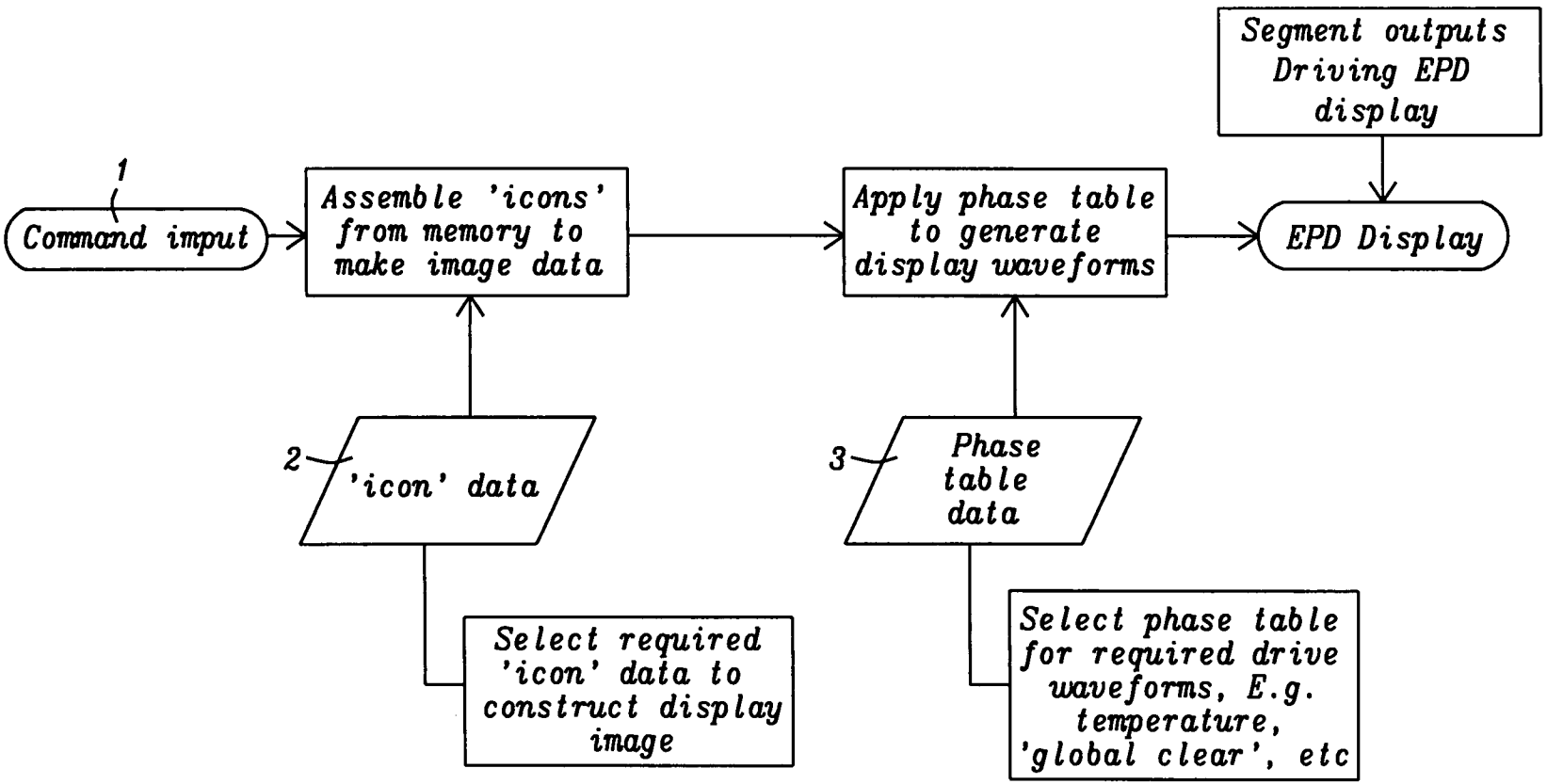
FIG. 1 shows a structured flow diagram outlining the EPD driver invented from a data processing point of view.

FIG. 1 shows a structured flow diagram outlining the EPD driver invented from a data processing point of view. The input commands 1 select an "icon" data 2, or select multiple "icon" data 2 OR'd together to create the image data to be displayed. The "icon" data is a bitmap representation of the image data to be displayed. To generate the required display waveforms the phase table data 3 is selected which contains the mapping information for each data bit transition and the dwell-time for each segment of waveform.

Figure 2:
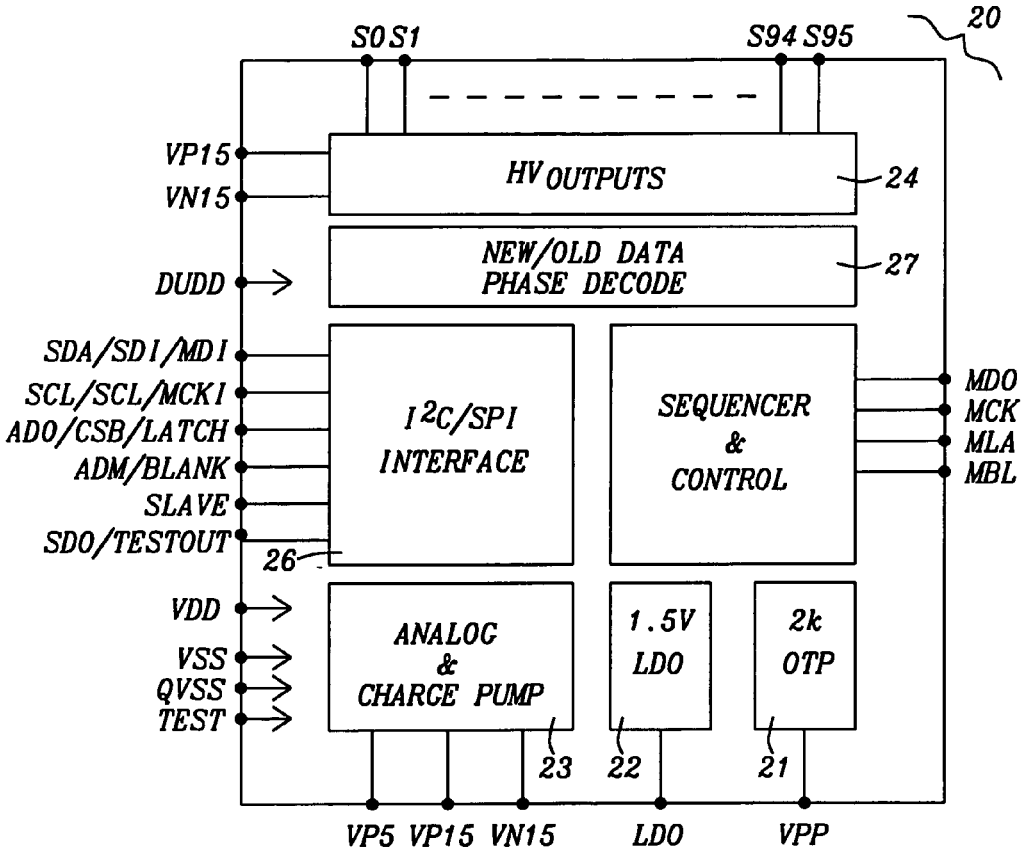
FIG. 2 shows a block diagram of the internal structure of a preferred embodiment of the EPD driver invented.

FIG. 2 shows a block diagram of the internal structure of an preferred embodiment of the EPD driver invented. All components shown in FIG. 2 are integrated in one die. The EPD driver 20 comprises an internal OTP (One Time Programmable, eg EPROM) memory 21, which has in the preferred embodiment 2K bytes with 32 bytes reserved for trim and register setup. A user area contains phase table and panel graphics data. Multiple pre-programmed phase tables can be stored in the OTP memory 21, allowing a simple mechanism to alter the waveform generation. Such a modification of waveform generation is required for example with temperature variations, blanking the display before updating the image, etc. The digital structure of the OTP memory 21 allows an user of the EPD driver 20 to define both phase table and data patterns in the OTP memory 21 so that the processing of the digital sequence control block 25 is kept to a minimum. Other sizes of OTP memory are possible as well.

The internal OTP memory 21 is storing both display graphics data and phase table data (display waveform definition). Any non-volatile memory is applicable for this purpose. The internal OTP memory 21 can be pre-programmed by the/any end-user to store both fixed "icon" images or numerical decode images, depending on the panel application. The stored "icon" image has a direct one-to-one correspondence of data-bit to segment driver output, which allows complete freedom to accommodate any EPD panel design and segment assignment.

Furthermore the EPD driver 20 comprises an LDO 22 and an Analog &Charge Pump block 23. The Analog &Charge Pump block 23 comprises a generator for a Power on reset (POR) pulse, an internal bias current generator, a bandgap voltage source, a bandgap filter, a high frequency clock for the charge pumps and a divider for the logic part of the EPD driver, a multi-stage charge pump, and an internal bias voltage generator generating various internal cascode voltages for the high voltage (HV) outputs block 24. In a preferred embodiment the HV output block 24 operates in a range of about +/−15 V; other ranges of output voltages are possible as well. The Analog &Charge Pump block 23 can also comprise additional components.

The sequencer&control block 25 is a digital block controlling the operation of the EPD driver 20. The sequencer&control block 25 comprises a main sequencer and state machines performing e.g. display control, phase data load from the OTP memory 21, and data pattern load from OTP memory 21. Other functions as e.g. trim and test functions are also performed by the state machines. Other data processing means as e.g. micro processors could also be used for the sequencer&control block 25.

Furthermore the EPD driver 20 comprises an $I^2C$/SPI interface block 26 allowing both single byte commands and multi-byte commands. Moreover the EPD driver 20 comprises an arrangement of registers; especially NEW/OLD registers 27 containing data to be displayed.

In order to change the display image, the display waveform, requires both the current (commonly referred to "OLD") display image data and the "NEW" display image data. This allows the display waveform generation to accommodate both segments that change from black/white and white/black as well as segments that remain unchanged at either black and white.

It should be noted that the present invention is not only applicable to black/white EPD but also applies to a 'color' EPD pane. The difference is the die color of the EPD ink used.

A host processor has 8 commands implemented in the EPD driver invented that allow a user to define the OLD and NEW data:

| Source of data | Host processor | OTP memory |
|---|---|---|
| Load NEW | 1 to 24 bytes | OTP address |
| OR NEW | 1 to 24 bytes | OTP address |
| Load OLD | 1 to 24 bytes | OTP address |
| OR OLD | 1 to 24 bytes | OTP address |

There is no restriction on the host processor, i.e. the system controller that communicates with the EPD driver IC, as long as it has a communication protocol that conforms to the I2C and SPI requirements. The commands to control the EPD driver IC are initiated from the host processor. The EPD driver IC is essentially a 'dumb' peripheral; it cannot initiate any interface communication.

This allows the user to either load the data from the host processor or from a specified OTP address. The user can then either load the data directly into the NEW/OLD register—replacing the data previously stored, or perform a logical "OR" of the data into the NEW/OLD register—, which adds to the data previously stored. When supplying data from the host processor, the number of bytes sent depends on the EPD panel size connected; this is done to keep communication data lengths to a minimum.

For example, the EPD display driver is used to generate a programmable keyboard legend for a mobile phone, depending on the phone usage the keyboard legend change to correspond to correspond with a current status; for example numeric keys for phone number entry, alphabetic keys for text entry, etc. In this example the user pre-programs the key legend bitmaps into the OTP memory at different addresses. In order to change the displayed keyboard legend the host processor issues the command to load the NEW register from the OTP address containing the required legend. The EPD display driver can then be configured to the start the display waveform sequence using the defined phase table at the given OTP address; and at the conclusion of the waveform sequence copies the NEW register to the OLD register, ready for the next display commands.

As a second example, the user requires a binary-coded-decimal (BCD) to 7-segment display decode for multiple digits. This is managed by storing each of the BCD segment decodes separately in the OTP memory, then building up the display image using the "OR new OTP address" command. By using the "OTP LOAD NEW" and "OTP OR NEW" commands the new display image can be built up. This is particularly useful when 7-segment type displays are used, as the decode for each digit can be addressed by simple arithmetic. It is obvious that not only 7-segment type displays can be used with the present invention; displays having other number of segments could be used as well.

Figure 3:
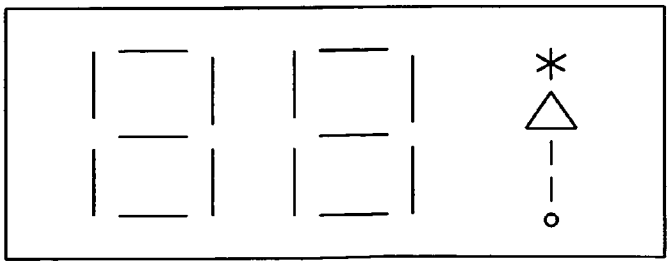
FIG. 3 shows a simple EPD display attached to the EPD driver invented, using a 7-segment type display.

In order to illustrate the example above FIG. 3 shows a simple EPD display attached to the EPD driver invented, using a 7-segment type display. It should be noted that the display driver invented could also support other numbers of segments.

Figure 4:
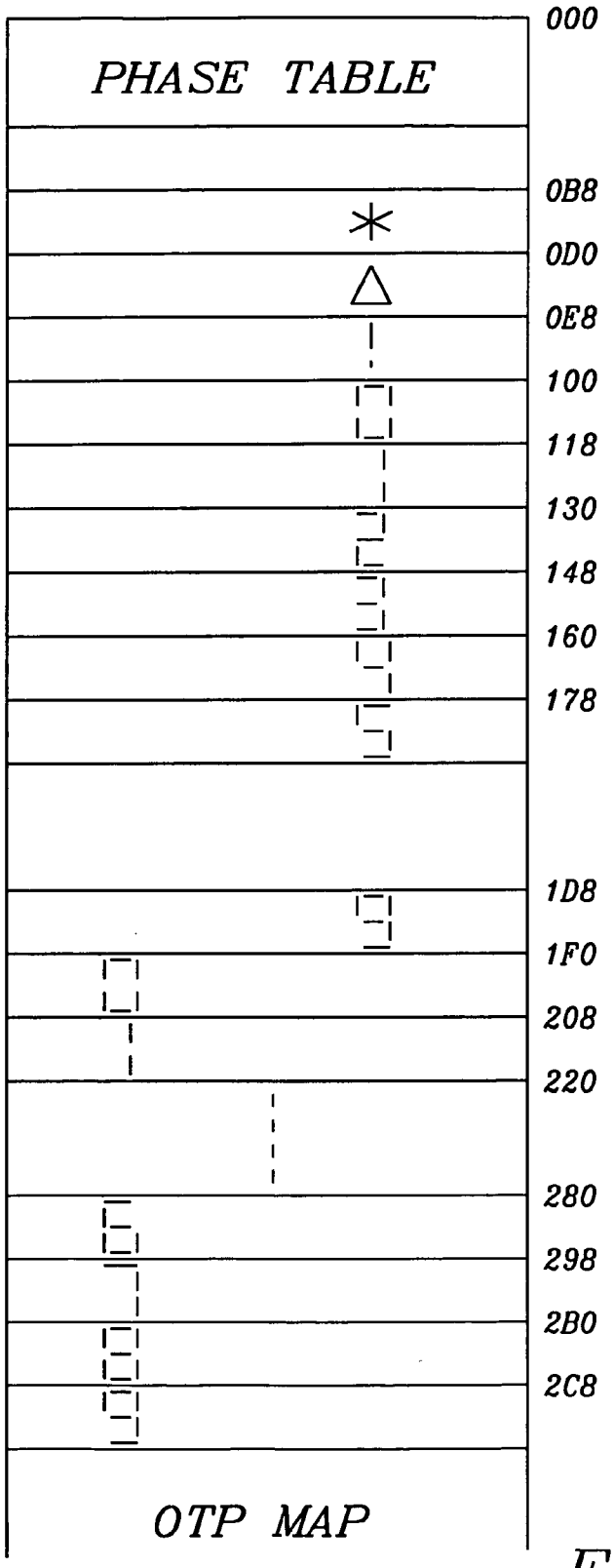
FIG. 4 depicts an OTP memory map illustrating how the OTP memory is programmed.

FIG. 4 depicts an OTP memory map illustrating how the OTP memory is programmed, with the phase table at address "0x00" and 23 stored panel graphics (each 24 bytes long) starting at address 0x0B8.

FIGS. 3 and 4 are non-limiting examples; the number and lengths of the stored panel graphics may alternatively differ from the examples shown.

The invention removes the requirement for a host processor to store display images and/or display image decodes of numerical data and simplifies the process required to construct a display image from stored bitmaps. Furthermore the invention provides pre-programmed multiple phase tables (phase/delay waveform definitions), allowing a simple mechanism to alter the waveform generation, required for example to accommodate temperature variations, blanking the display before updating an image, etc.

Figure 5:
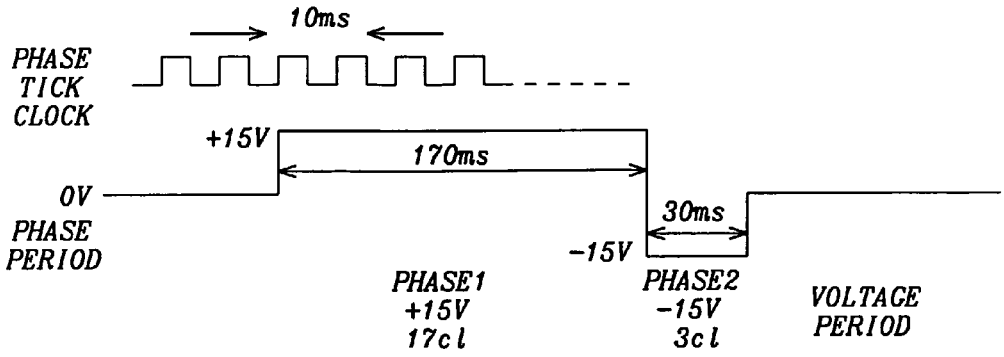
FIG. 5 illustrates a phase "tick" clock and a resulting phase period having two phases.

Each phase table is of arbitrary length, wherein each phase delay has a selected step of 1 to 31 "ticks" in the preferred embodiment. FIG. 5 illustrates a phase "tick" clock having a length of 10 ms. The programmable "tick" length can typically be modified between 5 ms and 15 ms in the preferred embodiment. Other ranges of the programmable "tick" length, as e.g. a range of about 3 ms minimum and about 17 ms maximum are possible as well. Furthermore FIG. 5 shows a resulting phase period having two phases, a first phase 1 with a voltage level of +15V and a length of e.g. 17 phase "tick" cycles (or 170 ms according to a 10 ms tick length of FIG. 5) and a phase 2 with a voltage level of −15V and a length of e.g. 3 phase "tick" cycles (or 30 ms). The phase period results:

Phase period=voltage period×# tick clock cycles.

In summary, main points of the present invention are

- User-definable display graphics bitmaps, internally stored in non-volatile memory, which can be placed anywhere on the display without any restriction, wherein the bitmaps can either be directly loaded or "OR"d with display data to create a new display image.
- Multiple stored bitmaps, internally stored in non-volatile memory, used to assemble complex display images
- Multiple phase tables, internally stored in non-volatile memory, each table of arbitrary length, wherein each phase delay has a selected step of 1 to 31 "ticks" in the preferred embodiment.
- NEW data is transferred to OLD data when the display sequence is completed.
- An internal display sequencer controls the charge pump and segment outputs.

Alternatively other DC-to-DC converters for generating the +/−15V could also be used. For example the use of boost converters (with an external inductor) would suffice—but would require more external components. Also an external capacitive DC/DC converter would be possible.

It should be noted that the invention could be applied not only to EPD display drivers but also to a multitude of other display technologies.

Any display technology that requires fixed 'icon' images or images built of multiple 'pictures' OR'd together, as e.g. LCD, LED, OLED, etc., are applicable to the present invention. The specifics of generating +/−15V and the sequencer to driver the display is primarily for an EPD technology.

Figure 6:
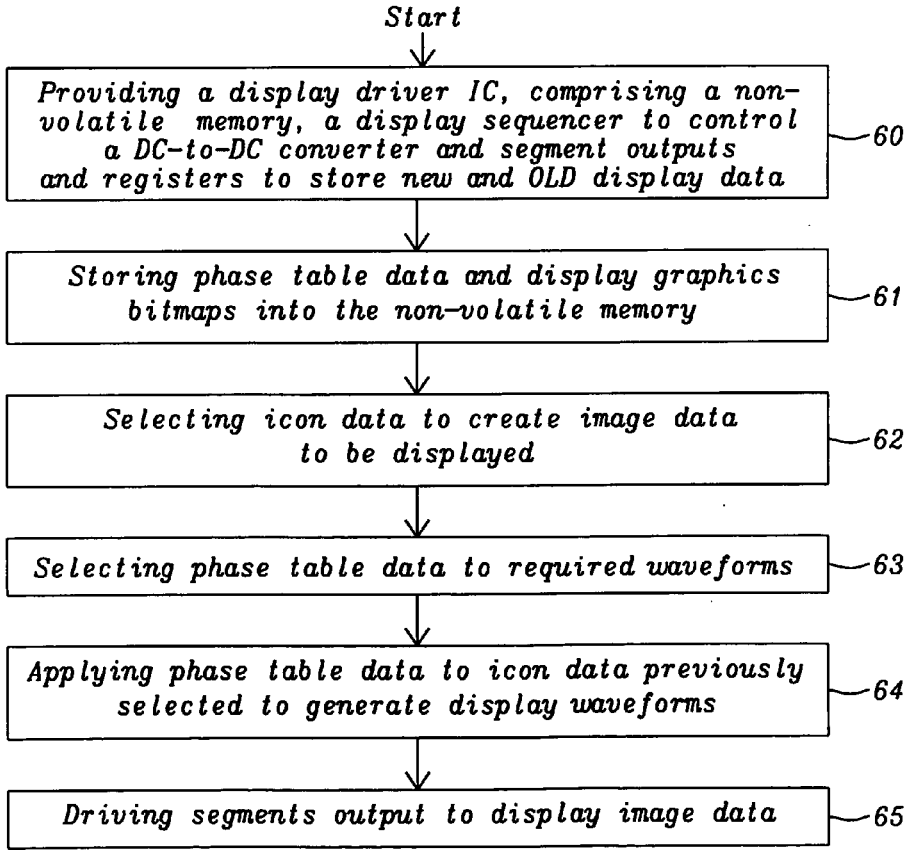
FIG. 6 illustrates a flowchart of a method invented for a display driver saving memory storage and computation effort of a host processor.

FIG. 6 illustrates a flowchart of a method for a display driver saving memory storage and computation effort of a host processor. A first step 60 describes the provision of a display driver IC, comprising a non-volatile memory, a display sequencer to control a DC-to-DC converter and segment outputs and registers to store new and OLD display data. The next step 61 depicts storing phase table data and display graphics bitmaps into the non-volatile memory. The following step 62 illustrates selecting icon data to create image data to be displayed. Step 63 describes selecting phase table data for required waveforms. Step 64 discloses applying phase table data to icon data previously selected to generate display waveforms. The last step 65 illustrates driving segments output to display image data.

While the invention has been particularly shown and described with reference to the preferred embodiments thereof, it will be understood by those skilled in the art that various changes in form and details may be made without departing from the spirit and scope of the invention.

What is claimed is:

1. A method for a display driver for passively segmented electronic paper display saving memory storage and computation effort of a host processor, comprising the following steps:

(1) providing a host processor, and a display driver IC, comprising a non-volatile memory, an analog circuitry comprising a charge pump, a high voltage output block providing segment outputs to the display, an interface block comprising an interface to the host processor, conforming to I2C and SPI requirements, a display sequencer to control the charge pump and outputs for display segments and registers to store NEW and OLD display data, wherein phase decode is performed and wherein OLD display data are current data of an image to be displayed and NEW display data are new data of an image to be displayed and wherein the NEW display data are received from the host processor or from a specified address of the non-volatile memory;

(2) storing phase table data, which are display waveform definitions, and user-definable display graphics bitmaps, wherein display graphic bitmaps are data used to construct display images from stored bitmaps, into the non-volatile memory, wherein the images can be placed as desired on the display wherein the bitmaps can either be directly loaded or logically OR'd with display data to create a new display image;

(3) pre-programming one-time said non-volatile memory to store icon-images or numerical decode images depending on a panel application, wherein the icon-images have a direct one-to-one correspondence between the data-bit of the stored icon image and the segment driver output and wherein each of binary decoded-decimals segments are stored separately in the non-volatile memory and the decode for each digit is addressed by arithmetic;

(4) selecting data of an icon image as from the host processor or from a specified memory address to create data of an image to be displayed;

(5) selecting phase table data desired for required waveforms;

(6) applying phase table data to data of an icon image previously selected to generate display waveforms;

(7) defining OLD and NEW display data by commands implemented in display driver;

(8) driving segments output to display the image according its data; and (9) transferring NEW display data to OLD display data when display sequence is completed.

2. The method of claim 1 wherein said electronic paper display is a color electronic paper display.

3. The method of claim 1 wherein said image data are constructed by load functions from predefined bitmaps stored in the memory.

4. The method of claim 1 wherein said image data are constructed by logical OR function with display data.

5. The method of claim 1 wherein multiple stored bitmaps can be used to assemble complex display images.

6. The method of claim 1 wherein multiple phase tables can be stored in said non-volatile memory.

7. The method of claim 5 wherein each phase step can have a variable delay.

8. The method of claim 7 wherein each phase step can have a delay between 1 and 31 ticks.

9. The method of claim 7 wherein the ticks have a programmable length.

10. The method of claim 9 wherein said programmable length is in a range of about 3 ms minimum and about 17 ms maximum.

11. The method of claim 1 wherein a host processor has multiple commands implemented in the display driver.

12. The method of claim 11 wherein said multiple commands comprise load new data, logical OR new data, load old data, and logical OR old data, wherein these commands each refer either to a host processor or to the non-volatile memory.

13. The method of claim 1 wherein said pre-programming of said non-volatile memory to store numerical decode images is used to decode binary-coded-decimals to 7-segment displays by storing each of binary-coded-decimal segment decodes separately in an OTP memory (21), then building up the display image using a "OR new OTP address" command and by using a "LOAD NEW from OTP" and "OTP OR NEW" commands a new display image can be built up.

14. A display driver IC for a passively segmented electronic paper display saving memory storage and computation effort of a host processor, comprises:

a non-volatile memory for storing phase tables, which are display waveform definitions, panel graphics data, pre-programmed icon image data, wherein an icon image is a symbol representing a specific function or status, and numerical decode images, wherein icon image data is a bitmap representation of an icon image to be displayed and wherein the non-volatile memory can be pre-programmed to store both the icon images or numerical decode images and wherein the bitmaps can either be directly loaded or logically OR'd with display data to create a new display image;

a digital sequencer and control block controls operation of the display driver comprising a main sequencer and state machines performing display control and phase table data load from said non-volatile memory controlling a charge pump and segments outputs, wherein the phase table data, comprising mapping information for each data bit transition for each segment of waveform, is selected to generate the required display waveform;

an analog circuitry comprising said charge pump providing electrical power for driving display of images;

a high voltage output block; providing segment output to the display;

an arrangement of registers controlled by said digital sequencer and control block, wherein NEW and OLD display data are kept, wherein OLD display data are current data of an image to be displayed and NEW display data are new data of an image to be displayed, and wherein phase decode is performed; and an interface block comprising an interface to the host processor, conforming to 12C and SPI requirements allowing both single byte commands and multi-byte commands.

15. The display driver of claim 14 wherein said electronic paper display is a color electronic paper display.

16. The display driver of claim 14 wherein said non-volatile memory has a capacity of 2 Kbytes.

17. The display driver of claim 14 wherein said memory stores bitmaps and phase tables.

18. The display driver of claim 14 wherein said interface block comprises an I2C-interface.

19. The display driver of claim 14 wherein said interface block comprises a SPI-interface.

20. The display driver of claim 14 wherein a charge pump generates the high voltages for the segment output pins.

21. The display driver of claim 14 wherein analog circuitry comprises a generator for a Power on reset (POR) pulse, a internal bias current generator, a reference (or bandgap) voltage source, a reference voltage (or bandgap) filter, a high frequency clock for the charge pumps and a divider for the logic part of the EPD driver, a multi-stage charge pump, and an internal bias voltage generator generating various internal cascode voltage for the high voltage (HV) outputs block.

22. The display driver of claim 14 wherein said interface block allows both single byte commands and multi-byte commands.

23. The display driver of claim 14 wherein said digital block comprises state machines.

24. The method of claim 1 wherein said commands implemented in display driver comprises:

load NEW data—from the host processor or from non-volatile memory address;

OR NEW data—from the host processor or from non-volatile memory address;

load OLD data—from the host processor or from non-volatile memory address; and

OR OLD data—from the host processor or from non-volatile memory address;

allowing to either load data from the host processor or from a specified non-volatile memory address and then load the data either directly into the NEW/OLD display data register or perform a logical OR of the data into the NEW/OLD register.

* * * * *